US005733387A

United States Patent [19]

Lee et al.

[11] Patent Number: 5,733,387

[45] Date of Patent: Mar. 31, 1998

[54] DUPLEX STAINLESS STEEL, AND ITS MANUFACTURING METHOD

[75] Inventors: Yong Deuk Lee; Kwang Tae Kim; Bong Un Kim; Yong Heon Lee, all of Pohang, Rep. of Korea

[73] Assignees: Pohang Iron & Steel Co., Ltd.; Research Institute of Industrial Science & Technology, both of Kyong Sang Book-Do, Rep. of Korea

[21] Appl. No.: 776,806

[22] PCT Filed: Jun. 5, 1996

[86] PCT No.: PCT/KR96/00084

§ 371 Date: Feb. 4, 1997

§ 102(e) Date: Feb. 4, 1997

[87] PCT Pub. No.: WO96/39543

PCT Pub. Date: Dec. 12, 1996

[30] Foreign Application Priority Data

Jun. 5, 1995 [KR] Rep. of Korea ..... 1995/14766
May 21, 1996 [KR] Rep. of Korea ..... 1996/17214

[51] Int. Cl.[6] ..... C22C 38/44; C21D 8/02

[52] U.S. Cl. ..... 148/325; 148/542; 148/609

[58] Field of Search ..... 148/325, 542, 148/609; 420/67

[56] References Cited

U.S. PATENT DOCUMENTS 4,765,953 8/1988 Hegenfeldt et al. ..... 420/65
5,284,530 2/1994 Azuma et al. ..... 148/325
5,298,093 3/1994 Okamoto ..... 148/325

FOREIGN PATENT DOCUMENTS 0545753 11/1992 European Pat. Off. .
0225203 1/1990 Japan .
0625744 2/1994 Japan .
0681037 3/1994 Japan .

OTHER PUBLICATIONS

J.I. Komi et al., "Effects of Sulphur Phosphorus and Cerium on the Hot Workability of a Ferritic–Austenitic Stainless Steel", Proc. of Int. Conf. on Stainless Steels. 1991. ISIJ. Tokyo. p. 807.

A. Paul et al., "Behaviour of 2205 Duplex Stainless Under Hot Working Conditions", 1993, Innovation of Stainless Steel, Florence, Italy, p. 3.297.

*Primary Examiner*—Deborah Yee

*Attorney, Agent, or Firm*—Webb Ziesenheim Bruening Logsdon Orkin & Hanson, P.C.

[57] ABSTRACT

A duplex stainless steel consisting of a ferrite phase and an austenite phase is disclosed which is superior in the hot ductility, the high temperature oxidation resistance, the corrosion resistance and the impact toughness. The duplex stainless steel is applied to marine facility and the like. The duplex stainless steel which consists of a ferrite phase and an austenite phase is composed of in weight %: less than 0.03% of C, less than 1.0% of Si, less than 2.0% of Mn, less than 0.04% of P, less than 0.004% of S, less than 2.0% of Cu, 5.0–8.0% of Ni, 22–27% of Cr, 1.0–2.0% of Mo, 2.0–5.0% of W, and 0.13–0.30% of N. Or there are further added one or two elements selected from a group consisting of: less than 0.03% of Ca, less than 0.1% of Ce, less than 0.005% of B and 0.5% of Ti. Further, the ratio ($Cr_{eq}/Ni_{eq}$) of the Cr equivalent ($Cr_{eq}$) to the Ni equivalent ($Ni_{eq}$) is 2.2–3.0. Further, the weight ratio (W/Mo) of the W to Mo is 2.6–3.4. That is, the duplex stainless steel of the present invention satisfies the above condition, and the $Ni_{eq}$ and $Cr_{eq}$ are defined as follows: $Ni_{eq}$=%Ni+30×%C+0.5×%Mn+0.33×%Cu+30×(%N−0.045), $Cr_{eq}$=%Cr+Mo+1.5×%Si+0.73×%W.

12 Claims, No Drawings

DUPLEX STAINLESS STEEL, AND ITS MANUFACTURING METHOD

FIELD OF THE INVENTION

The present invention relates to a duplex stainless steel for use in corrosive environments, such as in sea coast facilities and the like, and a manufacturing method therefor. More specifically, the present invention relates to a duplex stainless steel and a manufacturing method therefor, in which the steel consists of a ferrite phase and an austenite phase.

DESCRIPTION OF THE PRIOR ART

Generally, a duplex stainless steel in which ferrite and austenite phases are mixed together (called a "duplex stainless steel" below) is superior in corrosion resistance and in stress corrosion cracking resistance. Therefore it is widely used in applications requiring high corrosion resistance, such as oil well drilling pipes, power generating plant desulphuring facilities, paper manufacturing tank facilities, acid manufacturing tanks, sea water pumps, marine structures and the like.

Generally duplex stainless steel which is known to be superior in the corrosion resistance contains a large amount of Cr which is an alloy element used for promoting pitting corrosion resistance. In addition, Mo and Ni are employed as basic alloying elements. Duplex stainless steels are grouped roughly into two classifications.

One classification is UNS 31803 which is composed of: 21–23 weight % (to be called merely % below) of Cr, 4.5–6.5% of Ni, 2.5–3.5% of Mo, 0.08–0.20% of N, less than 2% of Mn, and less than 0.03% of C.

The other classification is SAF 2507 which is composed of: 24–26% of Cr, 6–8% of Ni, 3–5% of Mo, 0.24–0.32% of N, less than 0.5% of Cu, less than 1.2% of Mn and less than 0.03% of C.

The above stainless steels provide corrosion resistance almost equivalent to that of a super austenitic stainless steel. However, they are low in the hot ductility, and therefore, when these stainless steels are formed into a steel sheets, they are liable to form edge cracks during hot rolling. If edge cracks are formed, it leads to sheet ruptures and a decrease in the actual yield. Therefore, it is desirable that duplex stainless steel possesses a superior hot ductility.

A conventional method for improving the hot ductility of duplex stainless steel, involves adding Ce into the duplex stainless steel (J. I. Komi, et al., Proc. of Int. Conf. on Stainless Steels, ISIJ, Tokyo, 1991, p807). In this method, the S content is lowered to 30 ppm, and Ce is added, so that the segregation of S is prevented, thereby improving the hot ductility.

In addition, according to A. Paul et al., in order to promote the recrystallization of the austenite phase during hot rolling of duplex stainless steel, the strain rate is made high, thereby improving the hot ductility (Innovation of Stainless Steel, Florence, Italy, 1993, p3297).

However, the above described methods have the problem that they cannot be applied to a facility in which the temperature can be complemented by adjusting the temperature during the hot rolling.

All the above described duplex stainless steels do not contain W but Mo. However, a composite duplex stainless steel in which Mo and W are added has more superior hot ductility and corrosion resistance. Therefore, recently, studies have been made on duplex stainless steel in both Mo and W are added. For example, in a duplex stainless steel which was proposed by B. W Oh et al., a part of Mo is replaced with W in a steel which contains 20–22% of Cr. It is reported that a duplex stainless steel containing 2.7% of W and 1.05% of Mo has an improved corrosion resistance compared with that containing 2.78% of Mo (Innovation of Stainless Steel, Florence, Italy, 1993, P359).

However, the above steel has an excessively low Mo content, and therefore, the corrosion resistance is decreased.

As another example, European Patent EP 0.545.753A1 by H. Okamoto proposes a duplex stainless steel in which 2–4% of Mo and 1.5–5.0% of W are added. This steel is known to have high strengths and a high corrosion resistance. However, it is liable to cracking during a hot rolling, and the phase stability tends to be lowered.

In addition, there are still other examples. One further example is Korean Patent Application No. 94-38249 of the present inventors in which a duplex stainless steel is disclosed containing 22.5–23.5% of Cr. Another example is Korean Patent Application No. 94-38978 of the present inventors in which a duplex stainless steel is disclosed containing 24–26% of Cr. In these duplex stainless steels, Mo and W are compositely added to improve the corrosion resistance. Further, these steels can be manufactured by a facility such as the tandem rolling mill, and for this purpose, the high temperature oxidation resistance and hot ductility are improved. However, in the case where these duplex stainless steels containing Mo and W are applied to a structure requiring weldings, the heat affected zone shows a severe precipitation of intermetallic compounds. Consequently, the impact toughness is deteriorated, and therefore, the phase stability is liable to be lowered.

SUMMARY OF THE INVENTION

In order to improve the duplex stainless steels of Korean Patent Applications 94-38249 and 94-38978, the present inventors carried out repeated studies and experiments, and the present invention came to be proposed as a result of these efforts.

Therefore it is an object of the present invention to provide a duplex stainless steel which is superior in hot ductility and high temperature oxidation resistance, as well as in corrosion resistance and in phase stability of the heat affected zone.

It is another object of the present invention to provide a method for manufacturing a duplex stainless steel, in which the duplex stainless steel can be manufactured by using a tandem rolling mill.

The duplex stainless steel is manufactured by passing through the steps of: steel making, refining, preparing continuously cast slabs, surface grinding of the continuously cast slabs, heating to 1200°–1350° C. in a heating furnace, hot rolling, annealing, and pickling.

The preparing process for the continuously cast slab is divided into a continuous casting step and a slab cooling step. The continuous casting step is divided into a first continuous casting cooling stage and a second continuous casting cooling stage.

In the case where the continuously cast slab is manufactured by the general method, intermetallic compounds which are closely sensitive to the impact toughness are formed during a part of the second continuous casting cooling stage and the slab cooling step.

In the case where the intermetallic compounds are formed, the surface grinding of the continuously cast slab for improving the surface quality can lead to a formation of surface cracks.

Generally, when the intermetallic compounds are formed in the amount of 3–5%, the impact toughness is drastically lowered (L. Karlsson, Application of Stainless Steel 92, 9–11, Jun. 1992, Stockholm, Sweden).

During an operation at a high temperature of 1200°–1350° C., such cracks form oxide scales in the form of nodules, thereby causing surface defects.

The present inventors perceived that the precipitation of the intermetallic compounds causing the formation of cracks during the surface grinding of the slab is closely related to the cooling rate of the slab. Thus the present inventors are proposing the present invention.

Therefore it is still another object of the present invention to provide a method for manufacturing a duplex stainless steel, in which the cooling rate is properly controlled in a certain temperature interval during the making of the slab, so that the formation of the intermetallic compounds would be minimized, thereby preventing the occurrence of the surface defects during the surface grinding of the slab.

DESCRIPTION OF THE PREFERRED EMBODIMENT

The duplex stainless steel which consists of a ferrite phase and an austenite phase is composed of in weight %: less than 0.03% of C, less than 1.0% of Si, less than 2.0% of Mn, less than 0.04% of P, less than 0.004% of S, less than 2.0% of Cu, 5.0–8.0% of Ni, 22–27% of Cr, 1.0–2.0% of Mo, 2.0–5.0% of W, and 0.13–0.30% of N. Or there are further added one or two elements selected from a group consisting of: less than 0.03% of Ca, less than 0.1% of Ce, less than 0.005% of B and less than 0.5% of Ti.

Further, the ratio ($Cr_{eq}/Ni_{eq}$) of the Cr equivalent ($Cr_{eq}$) to the Ni equivalent ($Ni_{eq}$) is 2.2–3.0. Further, the weight ratio (W/Mo) of the W to Mo is 2.6–3.4. That is, the duplex stainless steel of the present invention satisfies the above conditions, and the $Ni_{eq}$ and $Cr_{eq}$ are defined as follows:

$$Ni_{eq}=\%Ni+30\times\%C+0.5\times\%Mn+0.33\times\%Cu+30\times(\%N-0.045),\text{ and}$$

$$Cr_{eq}=\%Cr+\%Mo+1.5\times\%Si+0.73\times\%W$$

The steel slab having the composition described above is heated at a temperature of 1250°–1300° C. within a heating furnace in which the excess oxygen amount is 2 vol %. Then a hot rolling is carried out with a strain rate of 1–10/sec. During the hot rolling, the reduction ratio of the first pass is 10–20%, and then, the reduction ratio is maintained at less than 40% thereafter. Then a finish hot rolling is carried out at a temperature of 1050°–1000° C. with a reduction ratio of 15–25%, thereby manufacturing a hot rolled sheet. Then the hot rolled steel sheet is subjected to an annealing and a pickling, and thus, the manufacturing of the duplex stainless steel according to the present invention is completed.

During the making of the steel slab, in the case where the Cr content is 22–23%, a cooling rate of 3° C./min is applied to a temperature range from 950°–800° C. to 650°–700° C. Meanwhile, in the case where the Cr content is 23–27%, a cooling rate of 5° C./min is applied to a temperature range from 1000°–800° C. to 650°–700° C. In this manner, the slab is water-cooled or air-cooled down to the normal temperature. Then the slab is heated to a temperature of 1250°–1300° C. within a heating furnace in which the excess oxygen amount is less than 2 vol %. Then a hot rolling is carried out with a strain rate of 1–10/sec. During the hot rolling, the reduction ratio of the first pass is 10–20%, and then, the reduction ratio is maintained at less than 40% thereafter. Then a finish hot rolling is carried out at a temperature of 1050°–1000° C. with a reduction ratio of 15–25%, thereby manufacturing a hot rolled sheet. Then the hot rolled steel sheet is subjected to an annealing and a pickling, and thus, the manufacturing of the duplex stainless steel according to the present invention is completed.

Now the composition of the duplex stainless steel according to the present invention will be described in detail.

Carbon is a strong austenite former, but if added in amounts more than 0.03%, it is precipitated in the form of chromium carbide, with the result that the corrosion resistance is lowered. Therefore, it is preferable to limit C to less than 0.03%.

Si is added as a deoxidizing agent, but if excess is added, the formation of the intermetallic compounds is promoted. Therefore the addition of Si should be preferably limited to 1.0%, and more preferably limited to less than 0.6%.

Mn increases the solubility of N during the melting of the duplex stainless steel. However, Mn forms MnS which decreases the corrosion resistance, and therefore, Mn should be preferably limited to less than 2.0%.

P is naturally added contained in the scrap and ferro-alloys which are added in the steel making process. If P is added in amounts more than 0.04%, the corrosion resistance and the impact toughness are deteriorated. Therefore, it is preferable to limit P to less than 0.04%, and more preferably to 0.03%.

S is also naturally contained in the scrap and ferro-alloys which are added in the steel making process. This element forms sulfides on the grain boundaries, thereby decreasing hot ductility. Sulfides cause pitting corrosion, and thus, markedly lower the corrosion resistance. Thus if the S content is greater than 0.004%, corrosion resistance and impact toughness are lowered, and therefore, it is preferable to limit the content of S to less than 0.004%, and more preferably to less than 0.003%.

Cu inhibits formation of the intermetallic compounds, and promotes corrosion resistance within a reducing atmosphere. Particularly, in a duplex stainless steel which contains 22.5–23.5% of Cr, impact toughness is improved by adding Cu. However, if the Cu content exceeds 2.0%, hot ductility is decreased. Therefore it is preferable to limit the content of Cu to less than 2.0%, and more preferably to less than 1.0%.

Ni is an important element which stabilizes the austenite phase. However, if the content of Ni departs from the proper range, the ratio of the austenite phase to the ferrite phase is disturbed, with the result that the duplex stainless steel loses its intrinsic properties. Particularly, in the case where the content of Ni is less than 5%, the ferrite phase which has a low solubility of N is increased, and chromium nitride is formed in the ferrite phase, with the result that the corrosion resistance and impact toughness are lowered. Therefore, the content of Ni should be preferably limited to 5–8%.

Cr is an important element for improving corrosion resistance. If the content of Cr is less than 22%, the duplex stainless steel cannot have the required corrosion resistance. On the other hand, if Cr exceeds 27%, the precipitation rate of the intermetallic compounds is increased, with the result that corrosion resistance and impact toughness are decreased. Therefore, the content of Cr should be preferably limited to 22–27%.

The Mo is an important element for improving the corrosion resistance like Cr. In particular, Mo shows a superior pitting corrosion resistance in a chloride environment. However, if the Mo content is less than 1%, a sufficient pitting corrosion resistance cannot be obtained. On the other hand, if the Mo content is more than 2%, it promotes the precipitation of the intermetallic compounds, with the result that the corrosion resistance and impact toughness are decreased. Therefore, the content of Mo should be preferably limited to 1–2%.

W is an important element for improving corrosion resistance. In particular, W provides superior pitting corrosion resistance at a low pH value, and delays the precipitation of the σ-phase of the duplex stainless steel. However, if the content of W is less than 2%, the above mentioned effects become insufficient, while if the W content exceeds 5%, oxidation rapidly progresses under a high temperature furnace atmosphere, and, in addition, the formation of the intermetallic is promoted. Therefore, the content of W should be preferably limited to 2–5%.

N is a strong austenite stabilizing element, and improves the corrosion resistance. If the content of N is less than 0.13%, the duplex stainless steel cannot have the required corrosion resistance, and promotes the precipitation of intermetallic compounds. On the other hand, if the content of N exceeds 0.27%, then the austenite phase is too greatly reinforced, with the result that the hot ductility is decreased. Therefore, the content of N should be preferably limited to 0.13–0.27%. However, if the content of S is less than 0.002%, the content of N can be increased up to 0.3%.

Meanwhile, if one or two elements selected from a group consisting of Ca, Ce, B and Ti are added, the hot ductility of the duplex stainless steel is further improved. However, the upper limits for the individual elements are 0.03% of Ca, 0.1% of Ce, 0.005% of B and 0.5% of Ti. If these upper limits are not observed, the elements function as superfluous additives, with the result that corrosion resistance and impact toughness are decreased.

In a duplex stainless steel having a composition as described above, the ferrite phase and austenite phase coexist. However, in the duplex stainless steel of the invention, the phase ratio of the austenite phase to the ferrite phase should be 65–55:35–45, in order to provide superior hot ductility, high temperature oxidation characteristics, corrosion resistance and impact toughness. The most preferable phase ratio of the austenite phase to the ferrite phase is 55:45. However, the phase ratio of the duplex stainless steel is greatly affected by the basic alloy elements Cr, Ni, Mo, W, N, Cu, Si and C. Therefore, if a proper phase ratio is to be ensured, a proper Cr equivalent ($Cr_{eq}$) and a proper Ni equivalent ($Ni_{eq}$) have to be designed.

The Ni equivalent ($Ni_{eq}$) can be calculated based on the following formula:

$$Ni_{eq}=\%Ni+30\times\%C+0.5\times\%Mn+0.33\times\%Cu+30\times(\%N-0.045)$$

Meanwhile, the Cr equivalent ($Cr_{eq}$) calculating formula does not include W which is a ferrite forming element. Therefore, the CR equivalent ($Cr_{eq}$) can be calculated based on the following formula in which a weighting value of 0.73 is applied according to the experiment of F. B. Pickering:

$$Cr_{eq}=\%Cr+\%Mo+1.5\times\%Si+0.73\times\%W$$

(The metallurgical Evolution of Stainless Steels, the American Society of Metals, Cleveland, Ohio, 1979, p132).

If the phase ratio of the duplex stainless steel is to be maintained at 55:45, the ratio $Cr_{eq}/Ni_{eq}$ has to come within the range of 2.2–3.0 based on the formulas for the $Cr_{eq}$ and $Ni_{eq}$. If the ratio $Cr_{eq}/Ni_{eq}$ departs from the above mentioned range, then the phase ratio of the duplex stainless steel departs from the ratio of 55:45, with the result that the high temperature oxidation characteristics, corrosion resistance and hot ductility are decreased.

Even if the ratio $Cr_{eq}/Ni_{eq}$ comes within the above mentioned range, and even if the total content of Mo and W comes within the desirable range so as to provide a good hot ductility, if the weight ratio of W/Mo is not proper, then impact toughness is adversely affected due to the precipitation of the intermetallic compounds. That is, in the steel of the present invention in which the Cr content is 22–27%, when the weight ratio of W/Mo is 2.6–3.4, the hot ductility becomes superior. Particularly, owing to the reduced formation of the intermetallic compounds in the heat affected zone, the phase can be stabilized.

Now the method for manufacturing the duplex stainless steel of the present invention will be described in detail.

The duplex stainless steel of the present invention can be manufactured according to the general method for making duplex stainless steel. However, in the case where it is manufactured by using a general stainless steel (non-duplex) production facility rather than the exclusive production facility, there is the disadvantage that reheating environment has to be adjusted for each kind of steel. In addition, other special conditions are also required.

In the case of a general stainless steel such as 304 stainless steel, when the slab is reheated, the amount of excess oxygen in the furnace is limited to about 3 vol %. In this environment, if a steel slab containing 22.5–23.5% of Cr is reheated, the amount of oxidation is drastically increased when the W content is more than 4%. Meanwhile, if a steel slab containing 24–26% of Cr is reheated, the amount of oxidation is drastically increased when the W content is more than 6.12%.

Therefore, in order to improve the high temperature oxidation characteristics of a duplex stainless steel containing large amounts of Mo and W, the present inventors adjusted the amount of excess oxygen within the environment of the reheating furnace to a low level. Thus, the local corrosion rate which adversely affects the high temperature oxidation amount and the surface condition is reduced. This proposal was disclosed in Korean Patent Application 95-14484 which was filed by the present inventors.

In the present invention, the above described heating method may be desirably applied to the heating of the slab of the duplex stainless steel of the present invention.

That is, during the reheating of the slab of the duplex stainless steel of the present invention, the excess oxygen within the environment of the heating furnace is controlled to less than 2 vol %. Under this condition, the heating temperature range is 1250°–1300° C.

Further, during the hot rolling of the heated slab, the initial reduction ratio is set to a low level, and thereafter, the reduction ratio is gradually increased. However, around 1050°–1000° C. the reduction ratio is lowered again. For example, the reduction ratio should be preferably set to 10–20% for the first rolling pass, and thereafter, the reduction ratio is maintained at 40%. Then when the temperature of the furnace reaches 1050°–1000° C., a finish hot rolling is carried out at a reduction ratio of 15–25%.

In a duplex stainless steel consisting of the ferrite phase and the austenite phase, the difference of the strengths between the phases is large, and therefore, the hot rolling is fastidious to carry out. Particularly, when the rolling temperature drops to below 1100° C., if the reduction ratio is large, then cracks are formed. Therefore, it is desirable to make the reduction ratio not exceed 40% at the maximum.

Further, if the reduction ratio exceeds 25% within the temperature range of 1050°–1000° C., then cracks can be formed due to the peculiar characteristics of the duplex stainless steel. On the other hand, if the reduction ratio drops to below 15%, it is not desirable in view of productivity.

Meanwhile the overall strain rate during the hot rolling should be preferably set to 1–10/sec. The reason is as follows. That is, if the strain rate exceeds 10/sec, the recrystallization behavior (softening behavior) becomes insufficient, with the result that cracks are liable to be formed. On the other hand if the strain rate is below 1/sec, the productivity is drastically lowered, likewise, an undesirable result.

Then the hot rolled sheet which is made according to the above described method is given an the usual annealing and acid wash, to thereby obtain a final duplex stainless steel.

The annealing conditions which are preferably applied to the present invention are as follows.

In a steel of the present invention containing W, the precipitation temperature is high. Therefore, in the case of the steel containing 22–23% of Cr, the annealing is carried out preferably above 1050° C. while in the case of a steel containing 23–27% of Cr, the annealing is carried out preferably above 1100° C.

During the annealing, the excess oxygen content of the atmosphere is set preferably to 3 vol %, so that the acid wash scales can be easily peeled during pickling process. The preferable excess oxygen content is 5–10 vol %.

Meanwhile, the W contained in the steel of the present invention is a volatile element, and therefore, if the excess oxygen content is increased, a speedy high temperature oxidation occurs. Therefore, the upper limit of the excess oxygen content should be preferably 10 vol %.

Meanwhile, in the case of a steel containing 22–23% of Cr, in order to inhibit the precipitation of intermetallic compounds, a cooling step is carried out down to room temperature at a cooling rate of more than 3° C./sec. In the case of the steel containing 23–27% of Cr, cooling is carried out down to the room temperature preferably at a cooling rate of more than 5° C./sec.

Meanwhile, the present inventors propose a steel slab preparing method for a duplex stainless steel as follows. That is, present inventors perceived that the precipitation of the intermetallic compounds causing surface cracks is closely related to the slab cooling rate. Therefore, during the making of the steel slab, the slab cooling rate is properly controlled in a certain temperature range so as to minimize the precipitation of intermetallic compounds. Thus occurrence of the surface defects can be prevented during slab surface grinding. This slab preparing method will be described in detail below.

In order to manufacture the duplex stainless steel, first a molten steel having a certain composition is continuously cast into slabs. Then the slab is cooled to room temperature, thereby obtaining a final slab.

The cooling process of continuous casting is divided into a primary cooling and a secondary cooling.

Generally, in making the slab for the duplex stainless steel, the continuous casting is initiated at a temperature of 1450°–1500° C., and is terminated at a temperature of 900°–1000° C. The primary cooling corresponds to a temperature range of 1350°–1420° C., while the secondary cooling corresponds to a temperature range from 1350°–1420° C. to 900°–1000° C.

In the present invention, the cooling rate is controlled during a part of the secondary cooling and during a part of the slab cooling stage.

That is, in the case of a steel containing 22–23% of Cr, the cooling rate during the continuous casting and the continuously cast slab cooling is set to more than 3° C./min within the temperature range from 950°–800° C. to 650°–700° C. Meanwhile, in the case of a steel containing 23–27% of Cr, the cooling rate within the temperature range from 1000°–800° C. to 650°–700° C. is set to more than 5° C./min.

According to the precipitation behavior of the intermetallic compounds obtained by the present inventors, in the case of a steel containing 22–23% of Cr, the highest temperature for precipitating the intermetallic compounds was found to be 950° C.

Therefore in the present invention, if the Cr content is 22–23%, it is preferable to set the cooling rate at 3° C./min for the temperature range from 950°–800° C. to 650°–700° C. The reason is as follows. That is, if the cooling rate for the above mentioned temperature range is less than 3° C./min, the intermetallic compounds are formed by more than 2%, with the result that surface cracks are formed. The preferable temperature range is 950°–700° C., and the preferable cooling rate is 3°–60° C./min.

Meanwhile, in the steel of the present invention containing 23–27% of Cr, the cooling rate for a temperature range of 1000°–800° C. should be preferably set at 5° C./min. The reason is as follows. That is, if the cooling rate is less than 5° C./min for the temperature range of 1000°–700° C. the intermetallic compounds are formed by more than 2%, with the result that defects due to surface cracks are generated. The preferable cooling rate is 5°–180° C./min.

The relationship between the slab cooling condition and the Cr content can be specifically expressed as follows.

The precipitation rate and the precipitation temperature range for the intermetallic compounds vary depending on the Cr content.

The higher the Cr content, the wider the precipitation temperature range becomes, and the faster the intermetallic compound precipitation rate becomes in the same temperature range.

Therefore, if the amount of the intermetallic compounds is to be adjusted, the cooling rate and the cooling temperature range have to be determined in accordance with the Cr content.

If the Cr content is 22–23%, the starting temperature at which the intermetallic compounds begin to be formed is below 950° C. The temperature range showing the highest precipitation rate is 800°–900° C., and the precipitation rate is very slow below a temperature of 700°–650° C.

Therefore, in the case of the steel of the present invention containing 22–23% of Cr, the cooling of the slab is carried out by setting the cooling rate preferably at more than 3° C./min within a temperature range from 950°–800° C. to 650°–700° C., and more preferably to 3°–60° C./min.

After cooling the slab within a temperature range of 650°–700° C., the general method is applied. That is, a water cooling or a strong air cooling is carried out to cool the slab down to room temperature. In a slab prepared in this manner, the formation of intermetallic compounds is less than 2%.

Meanwhile, in the case of a steel containing 23–27% of Cr, the temperature at which the intermetallic compounds begin to be formed is below 1050° C., and the temperature range showing the maximum precipitation rate is 800°–950° C., while the precipitation rate is very slow at temperatures below 700°–650° C.

Therefore, in the steel of the present invention containing 23–27% of Cr, the cooling rate for the temperature range from 1000°–800° C. to 650°–700° C. is set preferably at more than 5° C./min, and more preferably at 5°–180° C./min in carrying out the cooling for the slab.

After cooling the slab to a temperature of 650°–700° C. the general method is applied. That is, a water cooling or a strong air cooling is carried out to cool the slab down to room temperature. In the slab prepared in this manner, the precipitation amount of intermetallic compounds is less than 2%.

A method for manufacturing a duplex stainless steel by using a slab prepared in the above described manner is carried out in the following manner. That is, the duplex stainless steel slab according to the present invention is subjected to a surface grinding. Then a slab reheating and a hot rolling are carried out to obtain a hot rolled steel sheet. The hot rolled steel sheet is then annealed and pickled to, thereby obtain a duplex stainless steel consisting of a ferrite phase and an austenite phase.

Now the present invention will be described based on actual examples.

<EXAMPLE 1>

A steel having the composition as shown in Table 1 below was melted and cast into an slab shaped ingot of 50 Kg. The ingot was then heat-treated at a temperature of 1270° C. in a heating furnace for 3 hours.

Then the heated slab ingot was rolled down to 12 mm by using a test rolling mill. Wherein a reduction ratio of 18% was applied in the first rolling pass, and thereafter, the reduction ratio was gradually increased. Then around the temperature range of 1050°–1000° C., the reduction ratio was reduced again in carrying out the rolling. Then a water quenching was carried out. The finish rolling temperature was above 1000° C.

For this hot rolled duplex steel sheet, tests were carried out to determine the hot ductility, the high temperature oxidation resistance, the corrosion resistance and the impact toughness, thereby evaluating the phase stability. The test results are shown in Table 2 below.

The hot ductility of the sheet was tested by carrying out a high temperature tensile test which was conducted as follows. Heating was carried out up to 1290° C. at a heating rate of 20° C./sec by using a Gleeble Model 1500 furnace, and this temperature, was maintained for one minute. Then the test sheet was cooled down to 1050° C. at a rate of 10° C./sec, and was maintained at this temperature, for 10 seconds. Then a tensile stress was applied to each test sheet until breaking at a cross-head speed of 300 mm/sec. Then at 1050° C., if the reduction of area exceeded 80%, it was assigned a value of excellent (●). If it exceeded 70%, then it was assigned a value of adequate (■), while if it was less than 70%, it was assigned a value of ▲.

The high temperature oxidation test was carried out at a temperature of 1290° C. under an environment containing 3 vol % of excess oxygen for 3 hours, and the weight gain was adopted as the test result. In carrying out the heating, 90 minutes were consumed to reach 1290° C., and thereafter, the temperature was maintained at 1290° C. for 120 minutes. The evaluation result was expressed in the following manner. If the weight gain was less than 10 mg/cm$^2$.hr, it was assigned a rating of excellent (●), while if it exceeded 10 mg/cm$^2$.hr, it was assigned a rating of ▲.

In carrying out the corrosion resistance test, a modified ASTM G-48 test method was applied. That is, a dipping was carried out for 24 hours at each range of 2.5° C. Then the temperature at which pits were formed on the surface was measured, and the relative pitting corrosion resistances were shown for the respective test pieces.

In order to evaluate the phase stability of various steels, the respective test pieces were heat-treated at 900° C. for 3 minutes, and then, a Charpy impact test was carried out, and the test results were evaluated. In the steel containing 22–24% of Cr, if the impact energy was more than 150 J, the phase stability was assigned a rating of excellent (●), while if the impact energy was less than 150 J, the phase stability was assigned a rating of low (▲). On the other hand, in the steel containing 24–27% of Cr, if the impact energy was measured at more than 50 J, the phase stability was assigned a rating of excellent (●), while if it was less than 50 J, the phase stability was assigned a rating of low (▲).

TABLE 1

Unit: weight %

| Steel | | C | Si | Mn | Ni | Cr | Mo | Cu | W | N | P | S | Others | W/Mo | $Cr_{eq}/Ni_{eq}$ |
|---|---|---|---|---|---|---|---|---|---|---|---|---|---|---|---|
| 1 | x | 0.021 | 0.55 | 1.51 | 5.42 | 24.58 | 3.06 | 0.27 | — | 0.18 | 0.005 | 0.0019 | | 0 | 2.601 |
| 2 | x | 0.021 | 0.53 | 1.49 | 5.33 | 23.01 | 3.10 | 0.22 | — | 0.15 | 0.005 | 0.0017 | | 0 | 2.71 |
| 3 | x | 0.019 | 0.53 | 1.48 | 5.43 | 23.03 | 3.05 | 0.21 | — | 0.13 | 0.005 | 0.0017 | | 0 | 2.871 |
| 4 | x | 0.019 | 0.54 | 1.53 | 5.31 | 22.55 | 3.03 | 1.01 | — | 0.12 | 0.005 | 0.0017 | | 0 | 2.86 |
| 5 | x | 0.019 | 0.54 | 1.51 | 5.30 | 23.49 | 3.03 | 1.04 | — | 0.17 | 0.004 | 0.0016 | | 0 | 2.549 |
| 6 | x | 0.021 | 0.54 | 1.50 | 5.34 | 22.97 | 2.20 | 0.21 | 2.03 | 0.15 | 0.006 | 0.0016 | | 0.923 | 2.763 |
| 7 | x | 0.018 | 0.53 | 1.49 | 5.40 | 23.07 | 1.17 | 0.23 | 4.01 | 0.15 | 0.004 | 0.0017 | | 3.427 | 2.821 |
| 8 | x | 0.017 | 0.52 | 1.51 | 5.28 | 22.50 | — | 0.23 | 6.02 | 0.15 | 0.005 | 0.0017 | | — | 2.832 |
| 9 | x | 0.017 | 0.54 | 1.50 | 5.21 | 22.87 | 2.05 | 1.00 | 2.50 | 0.15 | 0.004 | 0.0014 | | 1.22 | 2.76 |
| 10 | x | 0.021 | 0.51 | 0.75 | 6.52 | 25.45 | 3.26 | 0.19 | — | 0.22 | 0.005 | 0.0017 | | 0 | 2.296 |
| 11 | x | 0.019 | 0.49 | 0.75 | 6.40 | 25.51 | 3.50 | 0.22 | — | 0.24 | 0.006 | 0.0022 | | 0 | 2.242 |
| 12 | x | 0.019 | 0.54 | 0.77 | 6.47 | 25.40 | 2.45 | 0.25 | 2.25 | 0.23 | 0.004 | 0.0014 | | 0.918 | 2.321 |
| 13 | x | 0.017 | 0.48 | 0.75 | 6.64 | 25.18 | — | 0.23 | 7.10 | 0.23 | 0.005 | 0.0015 | | — | 2.364 |
| 14 | x | 0.018 | 0.48 | 0.79 | 6.46 | 25.17 | 0.50 | 0.22 | 6.12 | 0.23 | 0.004 | 0.0016 | | 12.24 | 2.37 |
| 15 | x | 0.014 | 0.55 | 1.50 | 5.42 | 22.51 | 1.25 | 0.22 | 2.51 | 0.14 | 0.005 | 0.0018 | | 2.008 | 2.777 |
| 16 | o | 0.011 | 0.54 | 1.49 | 5.43 | 22.53 | 1.02 | 0.21 | 2.90 | 0.14 | 0.005 | 0.0016 | | 2.843 | 2.809 |
| 17 | x | 0.012 | 0.54 | 0.65 | 6.10 | 25.49 | 1.54 | 0.22 | 2.93 | 0.26 | 0.005 | 0.0015 | | 1.903 | 2.253 |
| 18 | x | 0.012 | 0.55 | 0.64 | 6.23 | 25.50 | 1.03 | 0.23 | 3.61 | 0.28 | 0.005 | 0.0017 | | 3.505 | 2.137 |
| 19 | x | 0.012 | 0.53 | 0.76 | 6.54 | 25.55 | 1.75 | 0.22 | 3.62 | 0.27 | 0.004 | 0.0013 | | 2.069 | 2.18 |
| 20 | x | 0.022 | 0.52 | 0.75 | 6.51 | 25.40 | 1.25 | 0.20 | 4.51 | 0.27 | 0.006 | 0.0015 | | 3.608 | 2.139 |
| 21 | x | 0.012 | 0.54 | 1.48 | 5.43 | 22.53 | 3.12 | 0.21 | — | 0.14 | 0.004 | 0.0015 | | 0 | 2.8 |
| 22 | x | 0.010 | 0.55 | 1.51 | 5.32 | 22.51 | 3.10 | 1.03 | — | 0.15 | 0.005 | 0.0017 | | 0 | 2.68 |
| 23 | x | 0.011 | 0.53 | 1.50 | 5.51 | 22.50 | 2.10 | 0.22 | 1.42 | 0.15 | 0.004 | 0.0013 | | 0.676 | 2.694 |
| 24 | x | 0.019 | 0.55 | 1.49 | 5.60 | 22.47 | 1.76 | 0.23 | 1.81 | 0.16 | 0.005 | 0.0016 | | 1.028 | 2.526 |
| 25 | x | 0.019 | 0.55 | 1.51 | 5.42 | 22.51 | 1.52 | 0.21 | 2.13 | 0.16 | 0.006 | 0.0016 | | 1.401 | 2.573 |
| 26 | x | 0.021 | 0.54 | 0.65 | 6.12 | 25.54 | 3.54 | 0.22 | — | 0.28 | 0.004 | 0.0015 | | 0 | 2.105 |
| 27 | x | 0.021 | 0.54 | 0.64 | 6.21 | 25.39 | 2.53 | 0.20 | 1.42 | 0.29 | 0.006 | 0.0015 | | 0.561 | 2.042 |

TABLE 1-continued

Unit: weight %

| Steel | | C | Si | Mn | Ni | Cr | Mo | Cu | W | N | P | S | Others | W/Mo | $Cr_{eq}/Ni_{eq}$ |
|---|---|---|---|---|---|---|---|---|---|---|---|---|---|---|---|
| 28 | x | 0.021 | 0.53 | 0.63 | 6.15 | 25.53 | 2.03 | 0.20 | 2.11 | 0.28 | 0.005 | 0.0015 | | 1.044 | 2.104 |
| 29 | x | 0.021 | 0.54 | 0.65 | 6.03 | 25.41 | 3.10 | 0.21 | 0.72 | 0.30 | 0.004 | 0.0014 | | 0.232 | 2.03 |
| 30 | x | 0.020 | 0.55 | 0.71 | 6.50 | 25.52 | 1.50 | 0.22 | 4.01 | 0.29 | 0.005 | 0.0015 | | 2.673 | 2.068 |
| 31 | x | 0.020 | 0.54 | 0.75 | 6.46 | 25.54 | 2.04 | 0.23 | 3.22 | 0.30 | 0.006 | 0.0015 | | 1.578 | 2.028 |
| 32 | x | 0.021 | 0.54 | 0.75 | 6.51 | 25.55 | 1.01 | 0.22 | 4.71 | 0.27 | 0.004 | 0.0020 | | 4.663 | 2.149 |
| 33 | x | 0.020 | 0.53 | 0.73 | 6.53 | 25.43 | 3.51 | 0.22 | 1.02 | 0.28 | 0.006 | 0.0030 | | 0.291 | 2.085 |
| 34 | x | 0.020 | 0.55 | 0.72 | 6.48 | 25.52 | 3.53 | 0.23 | 2.03 | 0.29 | 0.005 | 0.0028 | | 0.575 | 2.109 |
| 35 | x | 0.021 | 0.54 | 0.75 | 6.51 | 25.54 | 3.52 | 0.22 | 3.04 | 0.31 | 0.004 | 0.0028 | | 0.864 | 2.065 |
| 36 | o | 0.015 | 0.54 | 0.70 | 6.54 | 25.55 | 1.51 | 0.23 | 4.21 | 0.25 | 0.004 | 0.0020 | | 2.795 | 2.281 |
| 37 | o | 0.015 | 0.55 | 0.74 | 6.37 | 25.39 | 1.54 | 0.71 | 4.23 | 0.25 | 0.004 | 0.0020 | | 2.747 | 2.271 |
| 38 | o | 0.015 | 0.53 | 0.75 | 6.41 | 25.40 | 1.55 | 0.21 | 4.21 | 0.25 | 0.006 | 0.0020 | Ce:0.03% | 2.723 | 2.291 |
| 39 | o | 0.015 | 0.54 | 0.73 | 6.52 | 25.50 | 1.48 | 0.72 | 4.22 | 0.25 | 0.005 | 0.0020 | Ce:0.03% | 2.851 | 2.25 |
| 40 | o | 0.015 | 0.53 | 0.71 | 6.39 | 25.51 | 1.42 | 0.20 | 4.22 | 0.25 | 0.004 | 0.0020 | Ca:0.01% | 2.972 | 2.297 |
| 41 | o | 0.015 | 0.55 | 0.73 | 6.54 | 25.53 | 1.51 | 0.72 | 4.21 | 0.25 | 0.005 | 0.0020 | Ca:0.01% | 2.788 | 2.251 |
| 42 | o | 0.015 | 0.54 | 0.72 | 6.52 | 25.55 | 1.50 | 0.22 | 4.20 | 0.25 | 0.006 | 0.0020 | B:0.0025, Ti:0.14% | 2.8 | 2.282 |
| 43 | o | 0.015 | 0.52 | 0.73 | 6.51 | 25.52 | 3.51 | 0.21 | — | 0.25 | 0.004 | 0.0020 | Ce:0.03% | 0 | 2.201 |
| 44 | o | 0.015 | 0.55 | 1.53 | 5.43 | 22.50 | 1.01 | 0.22 | 3.04 | 0.15 | 0.004 | 0.0020 | | 3.01 | 2.691 |
| 45 | o | 0.015 | 0.54 | 1.51 | 5.29 | 22.54 | 1.03 | 0.71 | 3.03 | 0.15 | 0.005 | 0.0020 | Ce:0.03% | 2.942 | 2.692 |
| 46 | o | 0.015 | 0.55 | 1.52 | 5.71 | 22.55 | 1.25 | 0.71 | 3.60 | 0.15 | 0.006 | 0.0020 | | 2.88 | 2.645 |
| 47 | x | 0.015 | 0.53 | 1.54 | 5.34 | 22.51 | 3.02 | 0.72 | — | 0.15 | 0.004 | 0.0020 | | 0 | 2.646 |
| 48 | x | 0.017 | 0.48 | 0.75 | 6.64 | 25.18 | — | 0.23 | 7.10 | 0.23 | 0.005 | 0.0015 | | — | 2.368 |

o: Inventive steel. X: Comparative steel.

TABLE 2

| Steel | | Hot ductility | High temperature oxidation resistance | Critical pitting corrosion temperature | Impact toughness |
|---|---|---|---|---|---|
| 1 | x | ▲ | ● | 50° C. | ▲ |
| 2 | x | ■ | ● | 50° C. | ● |
| 3 | x | ■ | ● | 50° C. | ▲ |
| 4 | x | ▲ | ● | 50° C. | ▲ |
| 5 | x | ▲ | ● | 50° C. | ● |
| 6 | x | ■ | ▲ | 55° C. | ● |
| 7 | x | ■ | ▲ | 55° C. | ● |
| 8 | x | ▲ | ● | 55° C. | ▲ |
| 9 | x | ■ | ● | 55° C. | ● |
| 10 | x | ▲ | ● | 65° C. | ▲ |
| 11 | x | ▲ | ● | 65° C. | ▲ |
| 12 | x | ■ | ▲ | 70° C. | ● |
| 13 | x | ▲ | ▲ | 80° C. | ▲ |
| 14 | x | ▲ | ● | 80° C. | ▲ |
| 15 | x | ■ | ● | 55° C. | ▲ |
| 16 | o | ● | ● | 55° C. | ● |
| 17 | x | ■ | ● | 70° C. | ● |
| 18 | x | ■ | ● | 70° C. | ● |
| 19 | x | ■ | ● | 70° C. | ● |
| 20 | x | ■ | ● | 75° C. | ● |
| 21 | x | ■ | ● | 50° C. | ● |
| 22 | x | ▲ | ● | 52.5° C.■● | ● |
| 23 | x | ■ | ● | 50° C. | ▲ |
| 24 | x | ■ | ● | 50° C. | ▲ |
| 25 | x | ■ | ● | 70° C. | ▲ |
| 26 | x | ▲ | ● | 65° C. | ▲ |
| 27 | x | ▲ | ● | 70° C. | ▲ |
| 28 | x | ▲ | ● | 70° C. | ● |
| 29 | x | ▲ | ● | 65° C. | ▲ |
| 30 | x | ▲ | ● | 75° C. | ● |
| 31 | x | ▲ | ● | 72.5° C.■● | ● |
| 32 | x | ■ | ● | 75° C. | ● |
| 33 | x | ▲ | ● | 65° C. | ▲ |
| 34 | x | ▲ | ▲ | 70° C. | ▲ |
| 35 | x | ▲ | ▲ | 70° C. | ▲ |
| 36 | o | ● | ● | 75° C. | ● |
| 37 | o | ●, 81% | ● | 75° C. | ● |
| 38 | o | ●, 85% | ● | 75° C. | ● |
| 39 | o | ●, 84% | ● | 75° C. | ● |
| 40 | o | ●, 84% | ● | 75° C. | ● |
| 41 | o | ●, 84% | ● | 75° C. | ● |
| 42 | o | ●, 85% | ● | 75° C. | ● |

TABLE 2-continued

| Steel | | Hot ductility | High temperature oxidation resistance | Critical pitting corrosion temperature | Impact toughness |
|---|---|---|---|---|---|
| 43 | x | ● | ● | 65° C. | ▲ |
| 44 | o | ● | ● | 55° C. | ● |
| 45 | o | ● | ● | 55° C. | ● |
| 46 | o | ● | ● | 55° C. | ● |
| 47 | x | ■ | ● | 50° C. | ● |
| 48 | x | ▲ | ▲ | 80° C. | ▲ |

o: Inventive steel, x: Comparative steel

As shown in Table 2 above, the inventive steels which satisfy the composition of the present invention are superior in hot ductility, high temperature oxidation resistance, corrosion resistance and impact toughness relative to the comparative steels.

Further the inventive steels (38–42) in which one or two elements selected from among Ca, Ce, B and Ti are additionally added show further improved hot ductility compared with the inventive steels in which the additional elements are not added.

<EXAMPLE 2>

The inventive steel 16 of Table 1 was hot-rolled in the same manner as that of Example 1. The rolling conditions were as shown in Table 3 below, and thus duplex stainless steel sheets were obtained.

For the steel sheets thus manufactured, the formation of cracks was checked, and the results are shown in Table 3 below.

TABLE 3

| Example | Steel No. | Rolling conditions | Rolling schedule 1 pass | 2 pass | 3 pass | 4 pass | 5 pass | 6 pass | 7 pass | 8 pass | 9 pass | Crack formation |
|---|---|---|---|---|---|---|---|---|---|---|---|---|
| Comparative steel 1 | 16 | Reduction ratio (%) | 18.18 | 15.56 | 13.16 | 19.70 | 20.75 | 21.43 | 24.24 | 28.00 | 33.33 | Cracks formed |
| | | Strain rate | 2.5/sec | 2.6/sec | 2.2/sec | 2.4/sec | 2.8/sec | 3.1/sec | 3.8/sec | 4.7/sec | 6.0/sec | |
| Comparative steel 2 | 16 | Reduction ratio (%) | 11.0 | 24.34 | 30.50 | 35.19 | 27.69 | 32.22 | 30.04 | 23.08 | | Cracks formed |
| | | Strain rate | 1.6/sec | 2.5 sec | 3.2/sec | 4.1/sec | 5.7/sec | 7.1/sec | 8.5/sec | 10.5/sec | | |
| Invention steel | 16 | Reduction ratio (%) | 11.0 | 24.34 | 30.50 | 35.19 | 27.69 | 32.22 | 30.04 | 23.08 | | Cracks not formed |
| | | Strain rate | 1.7 sec | 2.7/sec | 3.5/sec | 4.5/sec | 5.0/sec | 6.6/sec | 7.7/sec | 8.0/sec | | |

As shown in Table 3 above, the inventive steel was slightly reduced during the first pass, and then, the reduction ratio was increased up to 36%. Then the reduction ratio was slightly reduced again during a finish pass (8th pass) which was carried out at a temperature of 1000°–1050° C. It can be seen that the finally obtained steel does not show any crack formation.

On the other hand, for the comparative steel 1, the reduction ratio was continuously increased, and a higher reduction ratio was applied to the 8th and 9th passes which were carried out at a temperature of 1000°–1050° C. The final sheet of this comparative steel showed cracks. In the case of the comparative steel 2, the first pass was carried out with a lower reduction ratio, and then, the reduction ratio was gradually increased. Then a lower reduction ratio was applied again at the finish temperature, as in the case of the inventive steel. However, in this case, the overall strain rate exceeded 10 sec, with the result that cracks were formed in the final steel sheet.

<EXAMPLE 3>

A steel having the composition of Table 4 below was melted, and was cast into ingots of 50 kg.

Then from the ingots, test pieces having dimensions of 3 mm (W)×5 mm (L)×2 mm (T) were cut out. Then a heat treatment furnace was employed in which the heating and cooling can be arbitrarily adjusted. In the case of the steel 1, the cooling rate was varied in the temperature range of 950°–700° C., while in the case of the steel 2, the cooling rate was varied in the temperature range of 1000°–700° C. While thus varying the cooling rate, the precipitation behavior of the intermetallic compounds was observed, and the observed results are shown in Table 5 below.

Here, an air cooling was carried out from 700° C. to the room temperature.

As for the values of Table 5 below, the precipitation amounts of the intermetallic compounds were observed by using the back-scattering electrons of a scanning electron microscope, and then, measurements were carried out by using an image analyzer.

TABLE 4

| Steel | C | Si | Mn | P | S | Ni | Cr | Cu | Mo | W | N |
|---|---|---|---|---|---|---|---|---|---|---|---|
| 1 | 0.023 | 0.54 | 1.52 | 0.002 | 0.002 | 5.49 | 22.23 | 0.18 | 1.50 | 2.50 | 0.16 |
| 2 | 0.025 | 0.51 | 0.76 | 0.002 | 0.002 | 6.38 | 24.80 | 0.18 | 1.56 | 4.35 | 0.29 |

TABLE 5

| Steel | Cooling rate (°C./min) | | |
|---|---|---|---|
| 1 | 1(°C./min) | 3(°C./min) | 60(°C./min) |
| | Amount of precipitates(%) 3 | 1.5 | 0 |
| 2 | 1(°C./min) | 5(°C./min) | 180(°C./min) |
| | Amount of precipitates(%) | 1.5 | 0.2 |

As shown in Table 5 above, In the case where the Cr content is 22.23% (Steel 1), the precipitation of the intermetallic compounds was 2.0% at a cooling rate of more than 3° C./min, while the precipitation is 3% at a cooling rate of 1° C./min.

Meanwhile, In the case where the Cr content is 24.80% (Steel 2), the precipitation of the intermetallic compounds is 2.0% at a cooling rate of more than 5° C./min, while the precipitation is 10% at a cooling rate of 1° C./min.

According to the present invention as described above, the ingredients and the ingredient proportions are properly adjusted, and the weight ratio of W/Mo and the relation between Creq and Nieq are properly controlled. Thus a duplex stainless steel is obtained which is superior in corrosion resistance, hot ductility, high temperature oxidation resistance and impact toughness. This duplex stainless steel can be suitably applied to various facilities which require a high corrosion resistance under a corrosive environment. Further the duplex stainless steel according to the present invention is particularly superior in hot ductility, and therefore, hot rolling conditions can be properly controlled, so that the manufacture of the steel sheets becomes very easy to achieve.

Further, according to the present invention, the precipitation of the intermetallic compounds can be maintained at 2.0% or less by properly controlling the cooling rate in a certain temperature range during the continuous casting and the slab cooling. Therefore slabs of a duplex stainless steel are provided in which surface defects are eliminated.

What is claimed is:

1. A duplex stainless steel containing a ferrite phase and an austenite phase, comprising in weight %: less than 0.03% of C, less than 1.0% of Si, less than 2.0% of Mn, less than 0.04% of P, less than 0.004% of S, less than 2.0% of Cu, 5.0–8.0% of Ni, 22–27% of Cr, 1.0–2.0% of Mo, 2.0–5.0% of W, and 0.13–0.30% of N;

a ratio ($Cr_{eq}/Ni_{eq}$) of an Cr equivalent ($Cr_{eq}$) to a Ni equivalent ($Ni_{eq}$) being 2.2–3.0; and a weight ratio (W/Mo) of W to Mo being 2.6–3.4; said ratios being defined by the following formulas, $$Ni_{eq}=\%Ni+30\times\%C+0.5\times\%Mn+0.33\times\%Cu+30\times(\%N-0.045);\text{ and}$$

$$Cr_{eq}=\%Cr+\%Mo+1.5\times\%Si+0.73\times\%W.$$

2. A duplex stainless steel containing a ferrite phase and an austenite phase, comprising in weight %: less than 0.03% of C, less than 1.0% of Si, less than 2.0% of Mn, less than 0.04% of P, less than 0.004% of S, less than 2.0% of Cu, 5.0–8.0% of Ni, 22–27% of Cr, 1.0–2.0% of Mo, 2.0–5.0% of W, and 0.13–0.30% of N;

further comprising: one or two selected from a group consisting of less than 0.03% of Ca, less than 0.1% of Ce, less than 0.005% of B and less than 0.5% of Ti;

a ratio ($Cr_{eq}/Ni_{eq}$) of an Cr equivalent ($Cr_{eq}$) to a Ni equivalent ($Ni_{eq}$) being 2.2–3.0; and a weight ratio (W/Mo) of W to Mo being 2.6–3.4; said ratios being defined by the following formulas, $$Ni_{eq}=\%Ni+30\times\%C+0.5\times\%Mn+0.33\times\%Cu+30\times(\%N-0.045);\text{ and}$$

$$Cr_{eq}=\%Cr+\%Mo+1.5\times\%Si+0.73\times\%W.$$

3. A method for manufacturing a duplex stainless steel containing a ferrite phase and an austenite phase, comprising the steps of:

continuously casting into slabs a molten steel comprising in weight %: less than 0.03% of C, less than 1.0% of Si, less than 2.0% of Mn, less than 0.04% of P, less than 0.004% of S, less than 2.0% of Cu, 5.0–8.0% of Ni, 22–27% of Cr, 1.0–2.0% of Mo, 2.0–5.0% of W, and 0.13–0.30% of N;

a ratio ($Cr_{eq}/Ni_{eq}$) of an Cr equivalent ($Cr_{eq}$) to a Ni equivalent ($Ni_{eq}$) being 2.2–3.0; and a weight ratio (W/Mo) of W to Mo being 2.6–3.4; said ratios being defined by the following formulas, $$Ni_{eq}=\%Ni+30\times\%C+0.5\times\%Mn+0.33\times\%Cu+30\times(\%N-0.045);\text{ and}$$

$$Cr_{eq}=\%Cr+\%Mo+1.5\times\%Si+0.73\times\%W;$$

cooling the steel slabs;

heating said steel slabs to a temperature of 1250°–1300° C. within a heating furnace having an excess oxygen of less than 2 vol %;

hot-rolling said heated slabs at an overall strain rate of 1–10/sec, a reduction ratio of 10–20% being applied to a first pass during the hot rolling, the reduction ratio being maintained up to 40% thereafter, and the reduction ratio being reduced to 15–25% in a temperature range of 1050°–1000° C. during a finish hot rolling; and carrying out an annealing and a pickling on the hot rolled steel sheets.

4. The method as claimed in claim 3, wherein Cr is contained by 22–23%, and a cooling rate of more than 3° C./min is applied during the continuous casting and the slab cooling in a temperature range from 950°–800° C. to 650°–700° C.

5. The method as claimed in claim 4, wherein a cooling rate of 3°–60° C./min is applied during the continuous casting and the slab cooling in a temperature range of 950°–700° C.

6. The method as claimed in claim 3, wherein Cr is contained by 23–27%, and a cooling rate of more than 5° C./min is applied during the continuous casting and the slab cooling in a temperature range from 950°–800° C. to 650°–700° C.

7. The method as claimed in claim 6, wherein a cooling rate of 5°–180° C./min is applied during the continuous casting and the slab cooling in a temperature range of 950°–700° C.

8. A method for manufacturing a duplex stainless steel containing a ferrite phase and an austenite phase, comprising the steps of:

continuously casting into slabs a molten steel comprising in weight %: less than 0.03% of C, less than 1.0% of Si, less than 2.0% of Mn, less than 0.04% of P, less than 0.004% of S, less than 2.0% of Cu, 5.0–8.0% of Ni, 22–27% of Cr, 1.0–2.0% of Mo, 2.0–5.0% of W, and 0.13–0.30% of N;

further comprising: one or two selected from a group consisting of less than 0.03% of Ca, less than 0.1% of Ce, less than 0.005% of B and less than 0.5% of Ti;

a ratio ($Cr_{eq}/Ni_{eq}$) of an Cr equivalent ($Cr_{eq}$) to a Ni equivalent ($Ni_{eq}$) being 2.2–3.0; and a weight ratio (W/Mo) of W to Mo being 2.6–3.4; said ratios being defined by the following formulas, $$Ni_{eq}=\%Ni+30\times\%C+0.5\times\%Mn+0.33\times\%Cu+30\times(\%N-0.045);\text{ and}$$

$$Cr_{eq}=\%Cr+\%Mo+1.5\times\%Si+0.73\times\%W;$$

cooling the steel slabs;

heating said steel slabs to a temperature of 1250°–1300° C. within a heating furnace having an excess oxygen of less than 2 vol %;

hot-rolling said heated slabs at an overall strain rate of 1–10/sec, a reduction ratio of 10–20% being applied to a first pass during the hot rolling, the reduction ratio being maintained at less than 40% thereafter, and the reduction ratio being reduced to 15–25% in a temperature range of 1050°–1000° C. during a finish hot rolling; and carrying out an annealing and a pickling on the hot rolled steel sheets.

9. The method as claimed in claim 8, wherein Cr is contained by 22–23%, and a cooling rate of more than 3° C./min is applied during the continuous casting and the slab cooling in a temperature range from 950°–800° C. to 650°–700° C.

10. The method as claimed in claim 9, wherein a cooling rate of 3°–60° C./min is applied during the continuous casting and the slab cooling in a temperature range of 950°–700° C.

11. The method as claimed in claim 8, wherein Cr is contained by 23–27%, and a cooling rate of more than 5° C./min is applied during the continuous casting and the slab cooling in a temperature interval from 950°–800° C. to 650°–700° C.

12. The method as claimed in claim 6, wherein a cooling rate of 5°–180° C./min is applied during the continuous casting and the slab cooling in a temperature range of 950°–700° C.

* * * * *

UNITED STATES PATENT AND TRADEMARK OFFICE

CERTIFICATE OF CORRECTION

PATENT NO. : 5,733,387

DATED : March 31, 1998

INVENTOR(S) : Yong Deuk Lee et al.

It is certified that error appears in the above-identified patent and that said Letters Patent is hereby corrected as shown below:

Column 1 Line 24 after "superior in" delete --the--.

Column 1 Line 42 after "ruptures and a" insert --drastic--.

Column 1 Line 44 between "possesses" and "superior" delete --a--.

Column 4 Line 22 after "naturally" delete --added--.

Column 4 Line 63 after "shows" delete --a--.

Column 5 Line 13 after "intermetallic" insert --compounds--.

Column 6 Line 3 after "provide" delete --a--.

Column 7 Line 10 after "given an" delete --the--.

Column 7 Line 14 "In a steel" should read --In the steel--.

Column 7 Line 15-16 "case of the"should read --case of a --.

Column 7 Line 34 before "room temperature" delete --the--.

Column 9 Line 10 after "pickled to" delete comma --,--.

Column 10 Line 6 after "80%," delete "it" and insert --the sheet--.

Column 10 Line 27 "of various steels" should read --of the various steels--.

Column 10 Table 1, in the headings, "Unit: weight %" should be above the table, not over last two columns.

UNITED STATES PATENT AND TRADEMARK OFFICE

CERTIFICATE OF CORRECTION

PATENT NO. : 5,733,387

DATED : March 31, 1998

INVENTOR(S) : Yong Deuk Lee et al.

It is certified that error appears in the above-identified patent and that said Letters Patent is hereby corrected as shown below:

Column 10 Table 1, last column heading, "$Cr_{eo}$" should read --$Cr_{eq}$--.

Column 11 Table 1, headings (continued), "Unit: weight %" should be above the table, not over last two columns.

Column 11 Table 1, last column heading, "$Cr_{eo}$" should read --$Cr_{eq}$--.

Column 11 Table 1, second column under "Steel" row 43, "O" should read --X--.

Column 11 Table 2, row 22, under column "Critical Pitting" after "52.5°C" delete --■●--.

Column 11 Table 2 row 31, under column "Critical Pitting" after "72.5°C" delete --■●--.

Columns 13-14, Table 3, first column headed "Example" last row, "Invention" should read --Inventive--.

Signed and Sealed this

Twenty-first Day of July, 1998

*Attest:*

*Attesting Officer*

BRUCE LEHMAN

*Commissioner of Patents and Trademarks*